United States Patent [19]

Lawrence

[11] Patent Number: 4,694,674

[45] Date of Patent: Sep. 22, 1987

[54] BENCH SYSTEM FOR REPAIRING AUTOMOBILES

[76] Inventor: David R. Lawrence, 28102 S. Salo Rd., Mulino, Oreg. 97042

[21] Appl. No.: 832,531

[22] Filed: Feb. 24, 1986

[51] Int. Cl.[4] ..... B21D 1/12

[52] U.S. Cl. ..... 72/305; 72/705; 187/8.41

[58] Field of Search ..... 72/705, 311, 457, 305; 187/8.41, 8.65, 8.74, 8.75, 8.54, 8.59

[56] References Cited

U.S. PATENT DOCUMENTS 1,870,128 8/1932 Lunati ..... 187/8.41
4,516,423 5/1985 Reich ..... 72/705
4,573,337 3/1986 Papesh ..... 72/705
4,606,216 8/1986 Riutta ..... 72/705

*Primary Examiner*—Lowell A. Larson
*Attorney, Agent, or Firm*—Chernoff, Vilhauer, McClung & Stenzel

[57] ABSTRACT

A bench system for straightening automobile bodies includes a central-pedestal lift with a horizontal bed adapted to structurally interlock with a detachable straightening bench having its own casters. The bench and the floor proximate the lift are provided with a plurality of engagement devices which cooperate to secure the bench to the floor for high straightening force applications while the bench is also secured to the lift.

12 Claims, 5 Drawing Figures

BENCH SYSTEM FOR REPAIRING AUTOMOBILES

BACKGROUND OF THE INVENTION

This invention relates to a bench system for repairing automobiles and particularly to a breakaway bench system for straightening automobile or other vehicle bodies.

Bench systems for straightening automobile bodies are well known. Generally they consist of an elevating structure having a supporting frame (the bench) mounted thereon for supporting the damaged automobile body above the floor at a comfortable working height with convenient access to the underside of the automobile. The bench is typically provided with attachment points for securing the automobile, and aligning and straightening equipment, to the bench.

Some benches are of a fixed height and include ramps or articulated mounts to facilitate loading of an automobile onto the bench such as shown in Hare U.S. Pat. No. 4,289,016 and Whitney, U.S. Pat. No. 4,291,570, respectively. Other benches, such as that shown in Wright U.S. Pat. No. 4,542,636, include an integral center lift assembly for selectively raising and lowering the bench. Still other bench systems, such as that marketed by Paulee Universal Bench of Los Angeles, Calif., include a fully detachable, breakaway bench including casters for detachable mounting on a four-post lift system.

Fully detachable, breakaway bench systems are advantageous in that the lift structure can be used to work on different bench-mounted vehicles without being monopolized by a single vehicle until all work is finished. However, four-post lift systems have disadvantages as compared to a central-pedestal lift of the type shown in Wright in that the four posts of the lift constitute an obstruction when the lift is not in use and restrict the use of the floor space which they occupy within the shop. Moreover, prior breakaway benches, because of their detachable nature, are of limited strength because they cannot rely to any great extent on the lift structure for their frame strength. Finally, a disadvantage of all prior elevated bench systems is that they are limited by the amount of force which can be applied to an automobile by a straightening tool which is anchored to the elevated bench.

SUMMARY OF THE INVENTION

The bench system of the present invention overcomes the aforementioned disadvantages of the prior art by providing a fully detachable, breakaway bench which is suitable for use with a subsurface central-pedestal lift, which relies on the lift structure for a substantial portion of its frame strength, and which is capable of being anchored directly to the floor of the shop to permit the application of very large straightening forces upon the bench-mounted automobile.

The bench system according to the present invention includes a central-pedestal lift with a horizontal bed and a breakaway bench which is adapted to be quickly and easily secured detachably to the bed of the lift, the bench having casters or the like for rolling the bench, with an automobile mounted thereon, along the floor when the bench is detached from the lift. The preferred embodiment of the bench system fashions the bed of the lift and the breakaway bench to structurally interlock when the bench is mounted upon the lift, the lift bed serving to strengthen and stiffen the bench. The bench mounts substantially symmetrically on the lift so that it is relatively balanced with respect to the pedestal.

The bench system of the present invention includes a plurality of anchoring devices which cooperate between the bench and the floor of the shop to detachably secure the bench directly to the floor while the bench is mounted on the lift to enable the application of very large straightening forces when needed.

Accordingly, it is a principal objective of the present invention to provide an improved bench system for repairing automobiles.

It is an associated object of the present invention to provide a breakaway bench system which is compatible with a central-pedestal lift.

It is a further object of the present invention to provide a breakaway bench system wherein the bed of a central-pedestal lift structurally interlocks with and significantly strengthens the bench.

It is another object of the present invention to provide a bench system which allows maximum utilization of floor space within the shop.

It is a further objective of the present invention to provide a bench system wherein the bench may be selectively anchored to the floor while secured to a lift.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
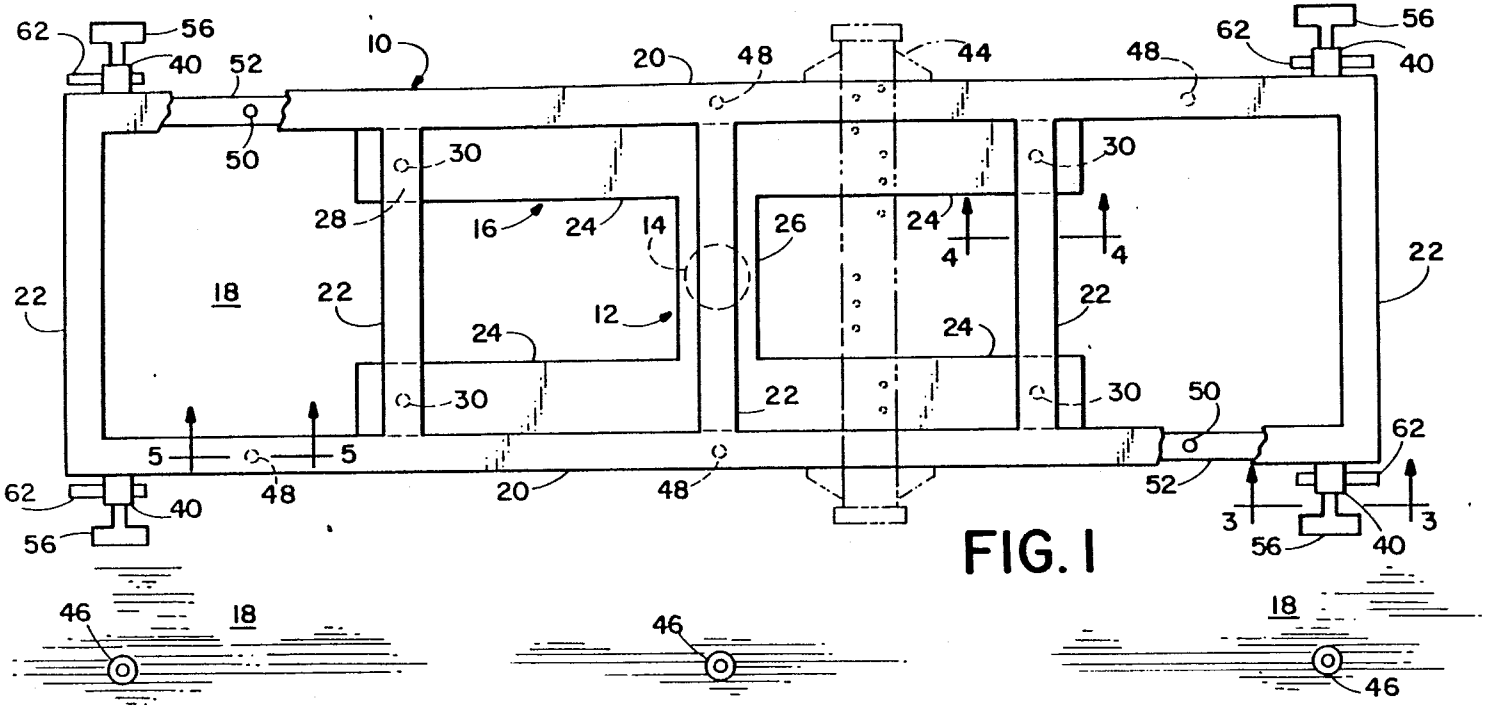
FIG. 1 is a plan view of the present invention showing the breakaway bench mounted on the bed of the lift.
Figure 2:
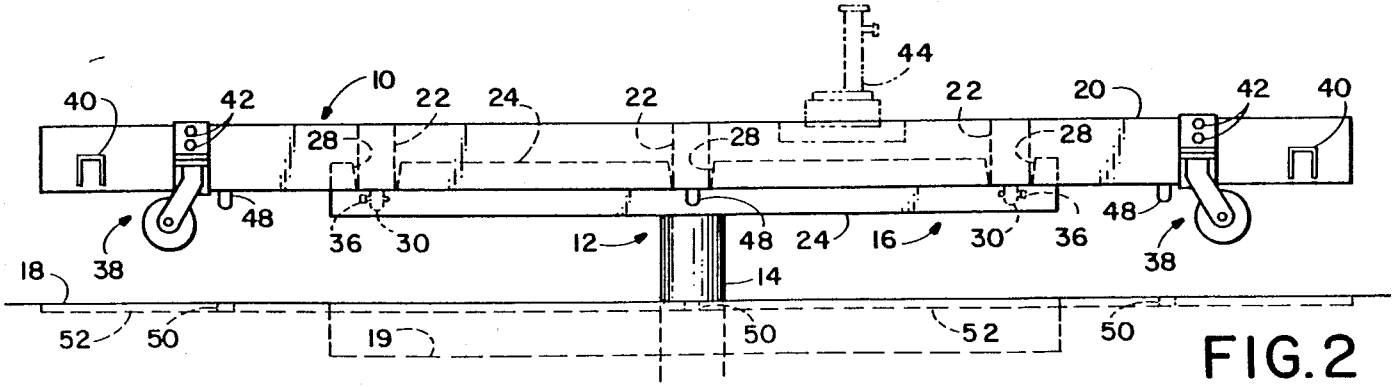
FIG. 2 is an elevational view of the invention shown in FIG. 1.

The preferred embodiment of the present invention as shown in FIGS. 1 and 2 includes a bench 10 and a subsurface hydraulic lift 12 having a centrally-located pedestal 14 and a horizontal bed 16. The lift is of the type which may be lowered until the bed is substantially level with the floor 18 by retraction of the bed into a cavity 19.

The bench frame includes a pair of elongate side rails 20 and a plurality of transverse struts 22 extending between the side rails. The lift bed in the preferred embodiment is H-shaped with a pair of spaced-apart legs 24 connected by an integral central cross member 26 which connects the legs of the lift bed to the pedestal.

Referring to FIG. 2 it can be seen that the spaced-apart legs of the lift bed and the central cross member have transverse channels 28 formed therein which correspond to certain ones of the transverse struts 22 of the bench frame. When the struts of the bench frame are received in the mating channels of the lift bed, the lift bed becomes structurally interlocked with the bench and acts to substantially strengthen and stiffen the bench in its opposition not only to vertical bending stresses but also to horizontal stresses tending to deform the rectangular shape of the bench. In particular, it is significant in this regard that the channels resist horizontal pivoting of the struts 22 of the bench frame.

Figure 4:
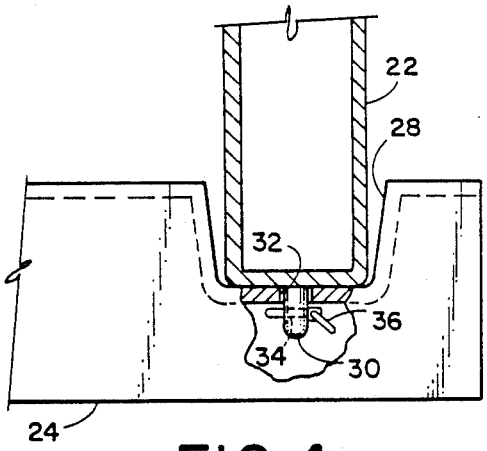
FIG. 4 is a partial cross-sectional view of a portion of the interlocking bench and lift bed taken along line 4—4 of FIG. 1.

As may be seen in FIGS. 2 and 4, the undersurface of the struts 22 of the bench frame include downwardly-projecting lugs 30 which are received in holes 32 formed in the bottoms of the channels of the lift bed. The lugs have horizontal bores 34 therethrough for receiving locking pins 36 for releasably securing the bench to the lift bed.

As shown in FIG. 2, the bench of the preferred embodiment includes a set of four removable casters 38 which permit the bench, either unloaded or with an automobile secured thereon, to be conveniently rolled along a flat surface such as the shop floor. The casters are adapted to be readily removed and reattached to the bench by provision of mounting bolts 42.

In operation, the automobile or other vehicle is positioned atop the bench in a conventional way, for example by moving the vehicle up a removable ramp structure (not shown). The bench may be rolled on its casters to the lift and positioned over the lift so that the struts 22 of the bench coincide with the channels 28 of the lift bed and the lugs 30 are aligned with the respective holes 32 in the channels. The lift is then raised so that the struts are received in the channels of the lift bed and interlock structurally therewith, with the lugs extending through the holes in the bottom of the channels. Once the lift has raised the bench, the locking pins 36 may be inserted into the lugs to secure the bench to the lift. This is also a convenient time for securing and adjusting conventional aligning and straightening equipment, such as a jig or clamp 44, or a hydraulic puller, since the raised bench gives ready access to the underside of the automobile. Thereafter, the body and/or frame of the automobile may be straightened by pushing or pulling on various portions of the automobile body or frame.

Figure 5:
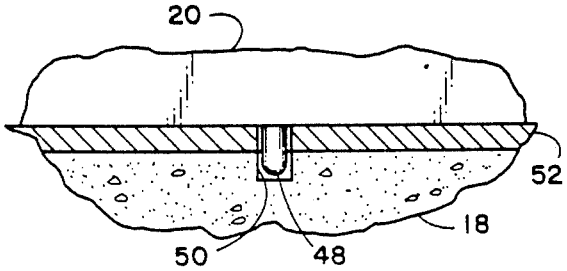
FIG. 5 is a partial cross-sectional view of another floor anchoring device taken along line 5—5 of FIG. 1.

However, with the bench positioned above the floor as shown in FIG. 2, the maximum amount of pulling or pushing force which may be applied is limited by the strength and rigidity of the lift and bench system. To overcome this problem, the bench system of the present invention provides a means for securely anchoring the bench, with an automobile body mounted thereon, directly to the solid, typically concrete floor of the shop while the bench remains attached to the lift. Both side rails 20 of the bench frame are provided with a plurality of downwardly-projecting pins 48. Arranged in the floor 18 directly beneath these pins are a plurality of sockets 50 for receiving, respectively, the pins therein after the casters 38 have been removed from the bench. As shown in FIG. 5, the preferred embodiment employs a steel reinforcing rail 52 embedded in the concrete floor, with the sockets 50 formed in the rail and the floor.

Figure 3:
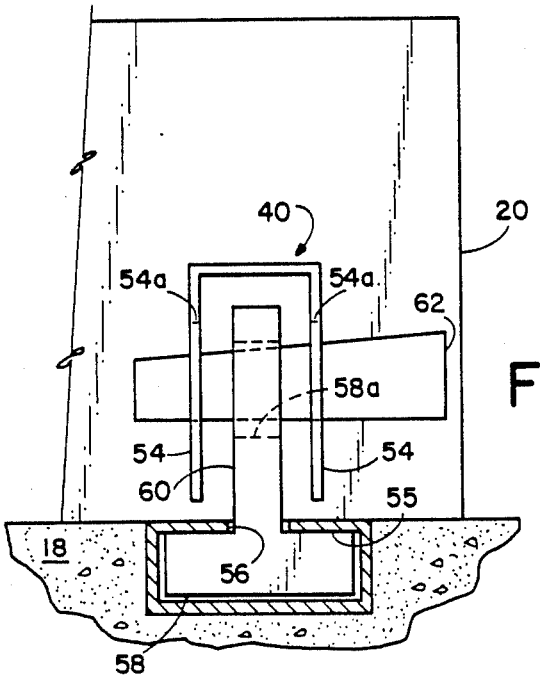
FIG. 3 is a partial elevational view of one of the floor anchoring devices taken along line 3—3 of FIG. 1.

The pins on the bench cooperate with the sockets in the floor to engage the bench solidly with the floor and resist forces applied to the bench or automobile body in a generally horizontal direction. However, in order to ensure that the bench remains in engagement with the floor, a second system for anchoring the bench to the floor which is capable of resisting forces in a vertical direction is provided. Referring to FIGS. 1, 2 and 3, a plurality of U-shaped brackets 40 are attached to the side rails of the bench. The brackets are oriented so that the open portion of the U-shaped bracket faces downwardly toward the floor. The arms 54 of each U-shaped bracket contain slots **54*a* therein. A metal socket member 55 having a T-shaped slot 56 is embedded in the floor directly beneath each bracket. The T-shaped slot is adapted to receive and retain a T-shaped anchor 58 also having a slot 58*a* in its stem 60 so that when the bench is resting on the floor, the slot 58*a* in the stem of the T-shaped anchor can be aligned with the slots 54*a* in the arms of the U-shaped bracket. A tapered finger 62 may be passed through the respective slots in the bracket and anchor to hold the bench securely to the floor, thereby vertically holding the pins 48 of the bench in engagement with the floor sockets 50. When the bench is thus engaged with the floor, pulling or pushing equipment can likewise be connected to anchors, such as 46**, imbedded in the floor, and much larger straightening forces can be applied to the vehicle than would be possible with the bench in an elevated condition.

The bench system of the present invention is extremely versatile. Existing central-pedestal lifts may be easily and inexpensively modified to provide a bed having channels to receive the struts of the straightening bench. Although a lift having a common H shape is shown in the preferred embodiment, other types of central-pedestal lifts such as those having X-shaped beds may also be modified to be suitable for the bench system shown herein.

A subsurface central-pedestal lift, in combination with a breakaway bench having its own casters or the like, gives the shop operator a wide variety of options to use his equipment and floor space most efficiently. For example, the central-pedestal lift may be used in combination with a straightening bench, may be used as a conventional lift, or may be retracted into the floor and the unobstructed floor space used for other purposes not involving the lift or the straightening bench.

The breakaway bench of the present invention may be used elevated in a conventional manner, may be lowered and engaged with the floor for heavy-duty straightening jobs, or may be detached from the lift while the car body remains attached thereon and rolled on its casters to another location for further work, or to be stored while another car is mounted upon another bench and loaded onto the lift.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for repairing the body of a vehicle comprising:

(a) lift means having a pedestal and a generally horizontal bed at the top of said pedestal for selectively raising or lowering said bed;

(b) bench means having a frame for supporting a vehicle thereon;

(c) means for structurally attaching said frame rigidly to the vehicle for movement in unison therewith;

(d) mating means on said bed and frame, respectively, for releasably attaching said frame supportably atop said bed in a position generally symmetrical with respect to said pedestal and for selectively detaching said frame from said bed with said vehicle attached to said frame for movement of said frame and said vehicle in unison to a location which is remote from said lift means; and (e) means structurally interlocking said bed and said frame for transferring vertical and horizontal stresses from said frame to said bed so as to strengthen said frame.

2. The apparatus of claim 1 wherein said bed includes a horizontal member and said frame includes a horizontal portion extending generally transverse to said horizontal member, said means structurally interlocking said bed and said frame including means for preventing pivoting in a horizontal plane between said horizontal portion of said frame and said horizontal member of said bed.

3. The apparatus of claim 2 wherein said horizontal member of said bed includes horizontal channel means for receiving and interlocking with said horizontal portion of said frame.

4. An apparatus for repairing the body of a vehicle comprising:

(a) bench means having a frame for supporting and securing a vehicle thereon;

(b) lift means for supporting said bench means and for selectively raising and lowering said bench means along a lift direction between an elevated position and a lowered position with respect to a floor;

(c) a bed located on top of said lift means;

(d) means for interlocking said frame and said bed into a rigid structure which is capable of supporting a vehicle that is attached thereto upon the raising of said lift means; and (e) engagement means secured to said floor for engaging said frame of said bench means when said bench means is in said lowered position and resisting forces, applied to said frame substantially transverse to said lift direction, independently of said lift means.

5. The apparatus of claim 4 wherein said engagement means are embedded in said floor.

6. The apparatus of claim 4 wherein said frame includes projections extending downwardly from said frame, said engagement means comprising receptacle means for matingly receiving said projections.

7. The apparatus of claim 4 wherein said engagement means further includes means for resisting forces, applied to said frame upwardly substantially in said lift direction, independently of said lift means.

8. The apparatus of claim 4 wherein said engagement means includes means for engaging said frame and resisting said forces in response to the lowering of said bench means to said lowered position.

9. The apparatus of claim 4, including mating means on said lift means and frame, respectively, for selectively releasably attaching said frame supportably on said lift means.

10. The apparatus of claim 9 wherein said lift means has a pedestal, said mating means including means for attaching said frame atop said pedestal in a position generally symmetrical with respect to said pedestal.

11. An apparatus for repairing vehicle bodies comprising:

(a) lift means having a pedestal and a generally horizontal bed at the top of said pedestal for selectively raising or lowering said bed;

(b) bench means having a frame for supporting a vehicle body thereon;

(c) said bed including a horizontal member and said frame including a horizontal portion which extends generally transverse to said horizontal member;

(d) mating means on said bed and frame, respectively, for selectively releasably attaching said frame supportably atop said bed in a position generally symmetrical with respect to said pedestal;

(e) means structurally interlocking said bed and said frame for transferring vertical and horizontal stresses from said frame to said bed so as to strengthen said frame;

(f) wherein said means structurally interlocking said bed and said frame includes horizontal channel means on said horizontal member of said bed for receiving and interlocking with said horizontal portion of said frame for preventing pivoting in a horizontal plane between said horizontal portion of said frame and said horizontal member of said bed.

12. An apparatus for repairing vehicle bodies comprising:

(a) lift means having a pedestal and a generally horizontal bed at the top of said pedestal for selectively raising or lowering said bed;

(b) bench means having a frame for supporting a vehicle body thereon;

(c) mating means on said bed and frame, respectively, for selectively releasably attaching said frame supportably atop said bed in a position generally symmetrical with respect to said pedestal; and (d) means for structurally interlocking said bed and said frame, so as to enable the transfer of vertical and horizontal stresses from said frame to said bed, solely in response to the raising of said lift means when said frame is positioned above said bed.

* * * * *